US005983819A

United States Patent [19]

Kyle

[11] Patent Number: 5,983,819

[45] Date of Patent: Nov. 16, 1999

[54] HATCH ASSEMBLY WITH A PIVOTAL ADJUSTMENT MECHANISM

[75] Inventor: James H. Kyle, Keene, N.H.

[73] Assignee: Pompanette, Inc., Charlestown, N.H.

[21] Appl. No.: 09/050,053

[22] Filed: Mar. 30, 1998

Related U.S. Application Data

[60] Provisional application No. 60/065,765, Nov. 17, 1997.

[51] Int. Cl.[6] ..... B63B 19/14

[52] U.S. Cl. ..... 114/201 R; 49/193

[58] Field of Search ..... 114/201 R, 203; 49/193

[56] References Cited

U.S. PATENT DOCUMENTS 3,861,083 1/1975 Goiot ..... 49/193

3,976,024 8/1976 Fillery ..... 114/201 R

*Primary Examiner*—Jesus D. Sotelo

*Attorney, Agent, or Firm*—Dougherty & Troxell

[57] ABSTRACT

A marine hatch assembly includes a rectangular ring shaped frame, a hatch cover hinged to the frame and a pivotal adjustment mechanism or adjuster for maintaining the hatch in a predetermined open position. The adjusting mechanism or adjuster includes a pair of telescoping elements one of which has a flexible joint therein. This flexible joint is prevented from flexing by the other of the telescoping elements until that element is withdrawn to a point beyond the flexible joint i.e., when the hatch cover is rotated beyond a predetermined angle. The adjusting mechanism also includes a clamp for maintaining the telescoping elements in a fixed relationship with respect to one another in order to maintain the hatch in a predetermined open position.

12 Claims, 5 Drawing Sheets

HATCH ASSEMBLY WITH A PIVOTAL ADJUSTMENT MECHANISM

This application is a Continuation-In-Part of my Provisional Application Ser. No. 60/065,765 which was filed on Nov. 17, 1997.

FIELD OF THE INVENTION

This invention relates to a hatch assembly which includes a pivotal adjustment mechanism for maintaining the hatch assembly in an open position and more particularly to a hatch assembly in which the pivotal adjustment mechanism includes a pair of telescoping elements and a flexible joint in one of the telescoping elements.

BACKGROUND FOR THE INVENTION

Hatch assemblies having pivotal adjustment mechanisms are well known and commonly used in marine vessels or the like to hold up hatch covers and deck hatches. Typically, they consist of various cross sections, often round that slide one inside the other. Their lengths are determined by the varying distance between the attachment points when the hatch is open or closed. One example of a hatch cover is disclosed in the U.S. Pat. No. 3,976,024 of Fellery. As disclosed therein, the stay mechanism includes an espagnolette bolt and means which permit a hatch cover to be rotated through an angle of 180°.

When a hatch needs to open more than 90° but less than about 130° most of the available adjusters may be used without problem. However, when a hatch cover has to be rotated 180° an added problem is introduced. In such instances, the lower end of the adjuster will strike the frame unless like the Fellery disclosure, it has an appropriate bend in the adjuster. However, including a bend in the one arm of the adjuster weakens the adjuster and causes the arm to protrude into the hatch opening several inches. For many applications, this intrusion into a cabin is unacceptable since it impacts on head room i.e. it provides an obstacle which may be struck by an individuals head. Furthermore, it prevents a screen from being fitted within a hatch cavity.

Notwithstanding the above, it is important that a hatch cover is sufficiently durable that it reduces the likelihood of an open hatch being inadvertently slammed shut as for example on an owner's or perhaps a child's fingers.

It is now believed that there may be a relatively significant market for an improved hatch assembly which includes an adjustment mechanism in accordance with the present invention.

It is believed that a market exists for a hatch assembly which allows a hatch cover to be open to an angle of 180° without a bent arm and which does not protrude into the cabin or prevent the installation of a screen within the hatch cavity when the hatch is in a closed position.

It is also presently believed that a hatch assembly including an adjustment mechanism in accordance with the present invention provides the aforementioned advantages. In addition, such assemblies can be manufactured at a competitive cost, are durable, unlikely to be inadvertently slammed shut and can be readily installed and/or removed in the same manner as the presently available commercial hatch assemblies. Such assemblies may also be manufactured with a pleasing appearance and are applicable to vessels of various sizes, and are suitable for plastic or metal hatches.

BRIEF SUMMARY OF THE INVENTION

In essence, the present invention contemplates a hatch assembly including a pivotal adjuster for maintaining the hatch assembly in an open position. The hatch assembly also includes an outer frame member which is adapted to fit into an opening in a marine vessel or the like in a customary manner, hinge means such as a marine hinge and a hatch cover which is pivotally mounted with respect to the frame by the hinge. The flexible adjuster or adjusting mechanism includes a pair of rod or tube like telescoping elements each of which includes first and second opposite ends. One of the telescoping elements is pivotally fixed at one end thereof to the frame. The other of the telescoping elements is pivotally fixed at one end thereof to the hatch cover. In this manner, the telescoping elements are extended outwardly with respect to one another ie in a direction away from one another as the hatch cover is rotated into an open position. As the hatch cover is rotated to a closed position, the pair of elements are telescoped inwardly toward one another, but are constructed and arranged to allow the hatch assembly to be fully closed before meeting their limit for compression. Means such as a clamp are provided for clamping or otherwise fixing the telescoping elements in a fixed relation with respect to one another for maintaining the hatch assembly in a predetermined open position, ie partially or fully opened position. A key element in the present invention resides in a flexible joint which is provided between the opposite ends of one of the telescoping elements. This flexible joint is prevented from flexing by the other of the telescoping elements until the hatch assembly is rotated by a predetermined amount as for example beyond 90°.

The present inventions also contemplates a pivotal adjustment mechanism for maintaining a boat hatch or the like in an open position. The mechanism includes a pair of telescoping elements each of which includes first and second opposite ends. Pivotal mounting means are attached to one end of each of said elements and are adapted to be pivotally attached to a hatch frame and cover respectively. The opposite ends of the elements are constructed and arranged in a telescoping relationship with the opposite end of one of the elements fitting in sliding relationship within the opposite end of the other of the elements which is of a tubular construction. One of the elements preferably the outer or tubular element includes a flexible joint which is prevented from flexing by the other of the telescoping elements until that element is withdrawn from the other of the elements by a predetermined amount. The predetermined amount being defined by the size of the hatch cover and the distance between the mountings on the frame and the cover. The pivotal adjustment mechanism also includes means such as a clamp for fixing the telescoping elements in a fixing relationship with one another and for releasing the telescoping elements so that can move with respect to one another as for example when a hatch cover is rotated into an open or closed position.

The invention will now be described in connection with the accompanied drawings wherein like reference numerals have been used to indicate like parts.

DETAILED DESCRIPTION OF THE PREFERRED EMBODIMENTS OF THE INVENTION

Figure 1:
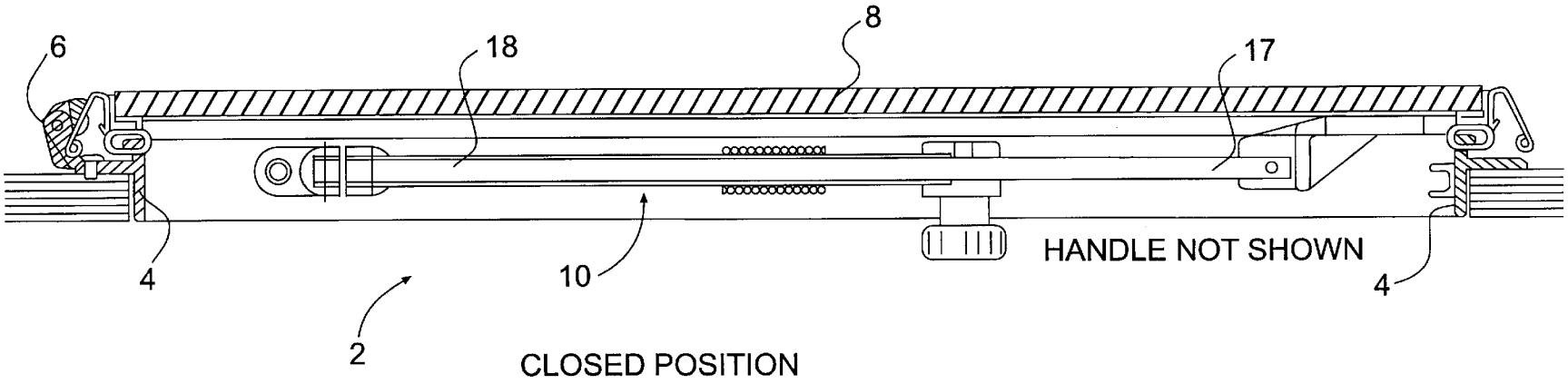
FIG. 1 is a cross sectional view of a hatch assembly in accordance with the present invention with the hatch in a fully closed position.

A hatch assembly 2 in accordance with a preferred embodiment of the invention includes an outer frame 4 which is adapted to fit into an opening in a marine vessel or the like and is fixed therein in a customary manner. As illustrated, the frame 4 has a generally rectangular or ring shape, but it should be recognized that it may take other forms as appropriate for fitting into the opening in a vessel. The assembly 2 also includes hinge means 6 such as a conventional marine hinge of the type used for hatches and ports and a hatch cover 8. The hatch cover 8 which may be transparent, translucent or opaque and which may include an aluminum or plastic frame (not shown) about its periphery is pivotally mounted to one side of the frame 4 by means of the hinge 6 and is opened or closed by rotating the cover 8 about the hinge 6. A conventional dog mechanism or handle (not shown) is used to clamp the assembly 2 in a closed position in a conventional manner. For example, a dog and catch is illustrated in my copending application entitled, Hatch Assembly for a Marine Vessel, Ser. No. 08/937,735 which was filed on Sep. 25, 1997. That application which is assigned to the same assignee as the present invention is incorporated herein in its entirety by reference.

Figure 2A:
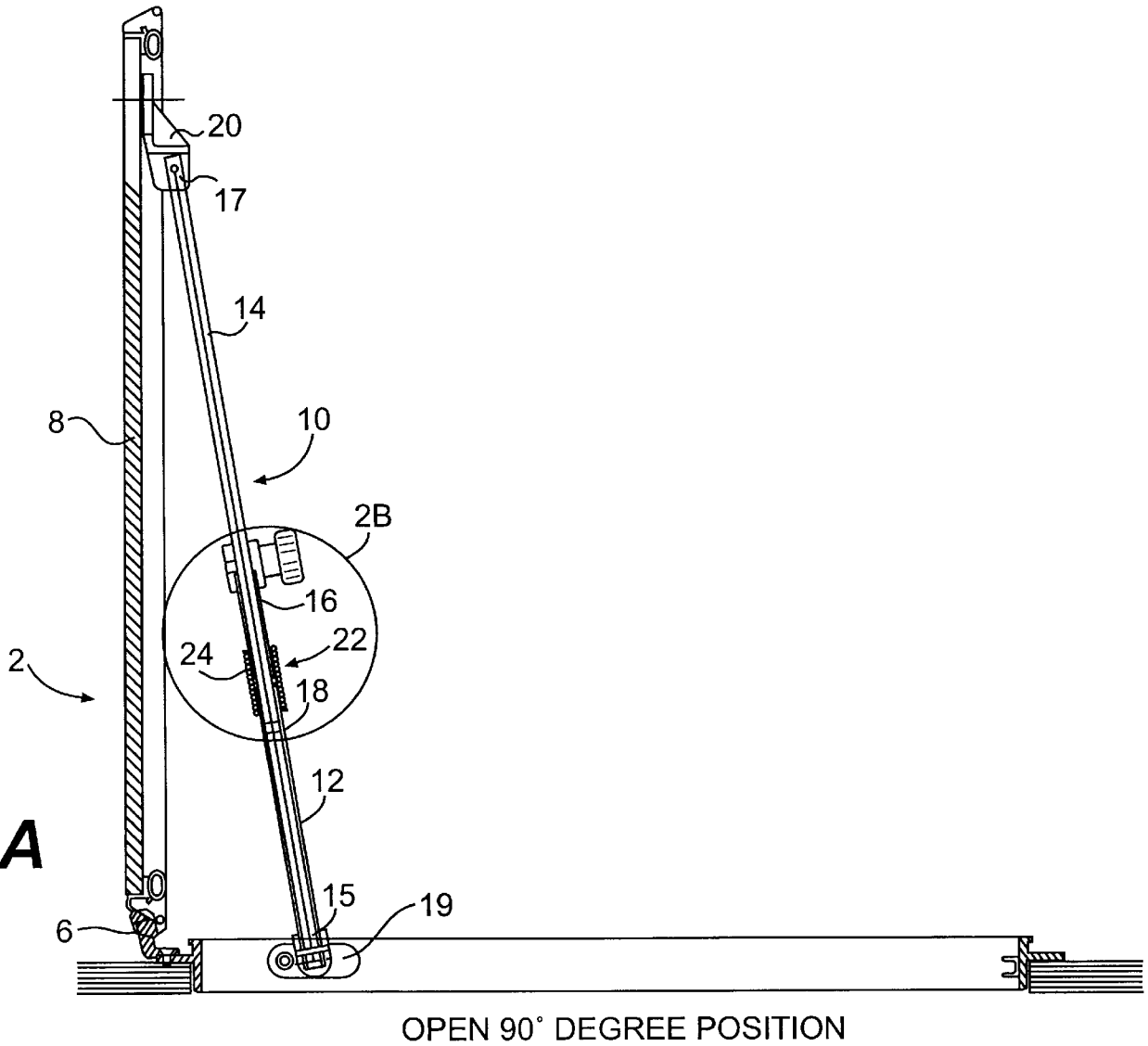
FIG. 2A is a cross sectional view of the hatch assembly shown in FIG. 1 but with the hatch open to about 90°.
Figure 3A:
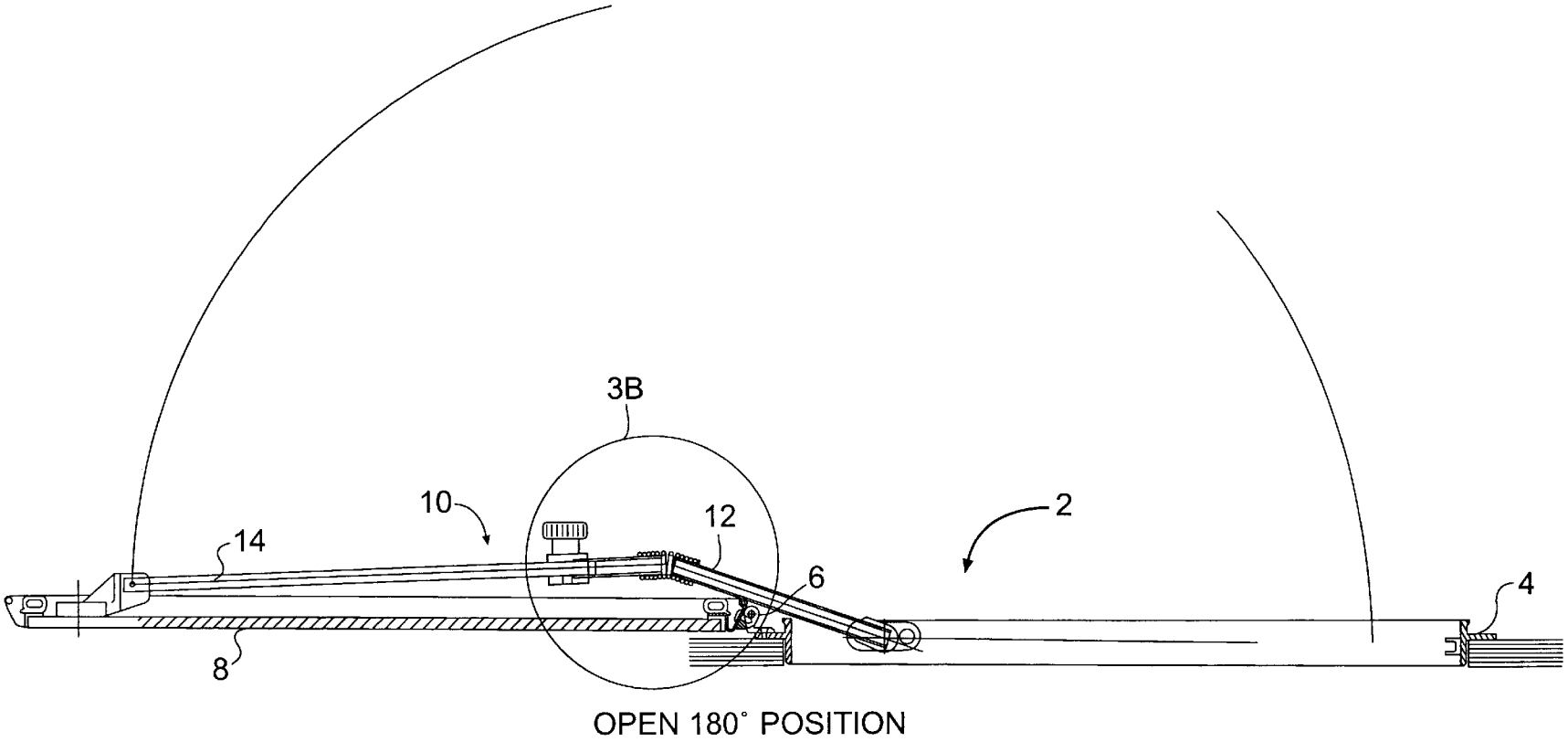
FIG. 3A is a cross sectional view of the hatch assembly shown in FIGS. 1 and 2 but with a hatch in a fully opened position ie with the cover rotated through about 180°.

The hatch assembly 2 in accordance with a preferred embodiment of the invention also includes a pivotal adjuster 10 for maintaining the hatch cover 8 in a preselected open position, as for example, about 90° as shown in FIG. 2A or about 180° as shown in FIG. 3A. The pivotal adjuster 10 includes a pair of telescoping elements 12 and 14 which include first and second opposite ends 15, 16 and 17, 18. Pivotal mounting means 19 and 20 are attached to the ends 15 and 17 of the elements 12 and 14 and also to one side of the frame 4 and the cover 6 respectively. These pivotal mounting means 19 and 20 are conventional and of the same type as used with conventional hatch adjusters and their use and installation will be well understood by persons of ordinary skill in the art.

The opposite ends 16 and 18 are constructed and arranged to fit together in a telescoping arrangement. For example, the element 12 has a generally tubular construction and is of a slightly larger cross section, as for example, a slightly larger diameter then the element 14 so that the element 14 which may be a tube or rod like element will fit within the element 12 in sliding engagement therewith.

A key feature of the present invention resides in a flexible joint 22 in the element 12 intermediate of the ends 15 and 16 and preferably close to the end 16. This flexible joint 22 may take various forms such as a coil spring 24 which tightly engages an outer surface of the element 12 on each side of a break therein. It should be recognized that the flexible joint can take other forms such as a flat spring within the element 14. For example, a flat spring construction as disclosed in the U.S. Pat. No. 4,869,552 of Toleson et al., could be used.

Figure 2B:
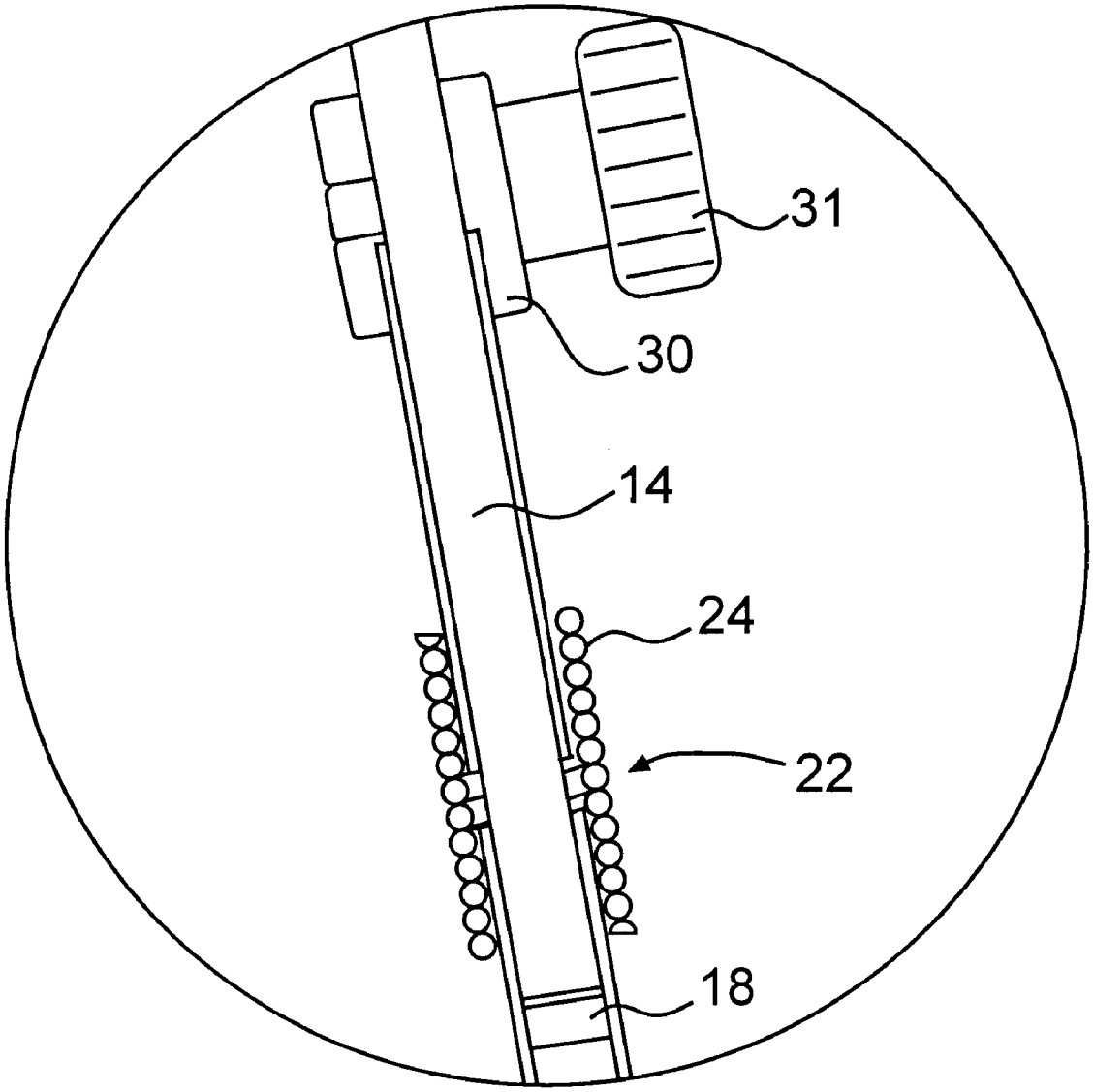
FIG. 2B is a enlarged sectional view of the flexible arm portion taken from the circle portion in FIG. 2A.
Figure 3B:
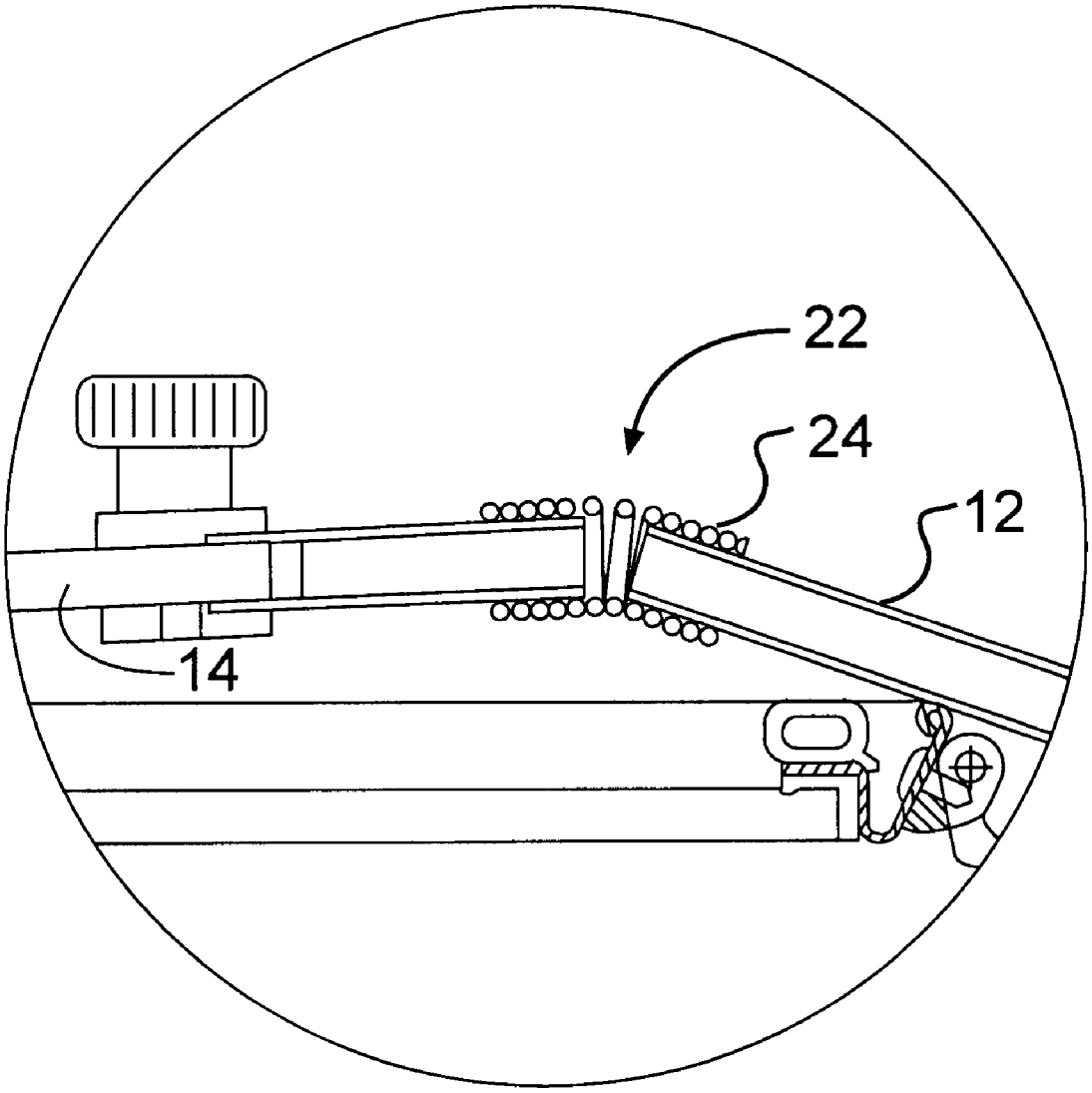
FIG. 3B is an enlarged sectional view of the flexible arm taken from the circle portion in FIG. 3A.

The flexible joint 22 is prevented from flexing by the element 14 as long as the element 14 extends into the tubular element 12 beyond the joint 22. For example, as shown in FIGS. 2A and 2B, the end 18 of the element 14 extends beyond the flexible joint 22 and prevents the joint 22 from flexing until after the hatch is open beyond 90° or more. Then, when the end 18 of element 14 is withdrawn beyond the joint 22 ie as shown in FIGS. 3A and 3B, the joint flexes and allows the hatch cover to lie flat.

The pivotal adjuster 10 also includes a clamp 30 which is preferably fixed to the end 16 of element 12 and by means of a knob 31 is used to clamp the elements 12 and 14 in fixed relationship with respect to one another in order to maintain the hatch in a predetermined position, as for example, shown in FIG. 2A.

While the invention has been disclosed in connection with its preferred embodiment, it should be recognized that changes and modifications may be made therein without departing from the scope of the appended claims.

What is claimed is:

1. A hatch assembly including an adjuster for maintaining the hatch assembly in an open position, said assembly including an outer frame adapted to fit into an opening in a vessel, hinge means and a hatch cover hingedly connected to said frame by said hinge means, an adjusting mechanism comprising a pair of telescoping elements each of which includes first and second opposite ends, one of said telescoping elements pivotally fixed at one end thereof to said frame and the other of said telescoping elements pivotally fixed at one end thereof to said hatch cover so that the telescoping elements are extended outwardly away from one another as the hatch cover is rotated into an open position and inwardly toward one another as the hatch assembly is closed, means for fixing said elements together in a fixed relationship with respect to one another for maintaining said hatch assembly in an open position, and one of said telescoping elements including a flexible joint which is prevented from flexing by the other of said telescoping elements until said hatch assembly is rotated by a predetermined amount.

2. A hatch assembly according to claim 1 in which one of said telescoping elements is rigid and in which said rigid telescoping element prevents said flexible joint from flexing until said hatch assembly is opened beyond the point where said cover and said frame form a 90° angle.

3. A hatch assembly according to claim 2 in which said telescoping elements include an outer element and an inner element in sliding engagement within said outer element and in which said means for fixing said element together is carried by said outer element.

4. A hatch assembly according to claim 3, in which said means for fixing said elements together is a clamp which is fixed to the second end of said outer element.

5. A hatch assembly accordingly to claim 3, in which said flexible joint comprises a spring.

6. A hatch assembly according to claim 5 in which said flexible joint includes a coil spring which tightly engages said outer element.

7. A hatch assembly according to claim 5, in which said flexible joint is adjacent to said hinge means when said hinge assembly is opened to a position in which said hatch cover and said frame form an angle of about 180°.

8. A hatch assembly according to claim 3, in which said telescoping elements are constructed and arranged so that said inner element is not withdrawn from sliding contact with said outer element as said hatch cover is rotated about said hinge means through an angle of about 180°.

9. A pivotal adjustment mechanism for maintaining a hatch in an open position comprising a pair of telescoping elements each of which includes first and second opposite ends, pivotal mounting means attached to one end of each of said elements and the opposite ends of said elements constructed and arranged in a telescoping relationship with the opposite end of one of said elements fitting in sliding relationship within the opposite end of the other of said elements and one of said telescoping elements including a flexible joint which is prevented from flexing by the other of said telescoping elements until one of said elements is withdrawn from the other of said elements by a predetermined amount and releasable means for fixing said elements in a fixed relationship with one another in a first position and for allowing said elements to move with respect to one another when in a second position.

10. A pivotal adjustment mechanism in accordance with claim 9 in which said releasable means for fixing said elements in a fixed relationship is a clamp which is fixed to one of said telescoping elements.

11. A pivotal adjustment mechanism in accordance with claim 10 in which said flexible joint includes a coil spring which tightly engages said one of said elements on each side of said flexible joint.

12. A pivotal adjustment mechanism in accordance with claim 11 in which said other of said telescoping elements has a tubular structure with an outer surface and wherein said coil spring tightly engages the outer surface of said other of said telescoping elements on each side of said flexible joint.

* * * * *